US007828631B1

(12) United States Patent
Herbert

(10) Patent No.: US 7,828,631 B1
(45) Date of Patent: Nov. 9, 2010

(54) DRYWALL POWER VACUUM SANDER

(76) Inventor: Gary Lynn Herbert, I-48 Lake Shore Dr., Lake Lotawana, MO (US) 64086

( * ) Notice: Subject to any disclaimer, the term of this patent is extended or adjusted under 35 U.S.C. 154(b) by 0 days.

(21) Appl. No.: 11/880,799

(22) Filed: Jul. 24, 2007

(51) Int. Cl.
*B24B 55/06* (2006.01)
*B24B 23/02* (2006.01)

(52) U.S. Cl. ..... 451/344; 451/354; 451/359; 451/456; 451/524

(58) Field of Classification Search ..... 451/344, 451/350–354, 356–359, 451, 456, 523, 524
See application file for complete search history.

(56) References Cited

U.S. PATENT DOCUMENTS 3,785,092 A * 1/1974 Hutchins ..... 451/357
4,782,632 A 11/1988 Matechuk
5,239,783 A 8/1993 Matechuk
5,545,080 A 8/1996 Clowers
6,659,852 B1 * 12/2003 Wettstein et al. ..... 451/557
6,860,799 B2 * 3/2005 Loveless ..... 451/354
7,220,174 B2 * 5/2007 Phillips et al. ..... 451/354
7,261,623 B1 * 8/2007 Palushi ..... 451/350
2008/0085664 A1 * 4/2008 Weiford et al. ..... 451/259

* cited by examiner

*Primary Examiner*—Timothy V Eley

(57) ABSTRACT

A motorized vacuum sander having a vacuum assembly (400) mounted on one end of a body tube (114) and a pivoting sanding head assembly (124) with an angle adjustment mechanism (511) mounted on the other end. The vacuum assembly (400) comprises a drive motor (102) mounted on the vacuum assembly rear end plate (420), a motor ventilation chamber (403), a dust chamber (409), a vacuum chamber (411), a main drive shaft (404), a dust seal (405), a centrifugal fan (408), a gearbox (414), and a dust bag (109) surrounding the vacuum assembly (400). The sanding head assembly (124) has a drive disk (514), and a sanding disk (516) which are operatively coupled to the gearbox (414) by a flexible drive cable (416). A dust tube extends from the vacuum assembly (400) through the body tube (114) and is connected to the sanding head assembly (124) dust ring (534) by a flexible dust tube (122).

3 Claims, 4 Drawing Sheets

DRYWALL POWER VACUUM SANDER

CROSS REFERENCE TO RELATED APPLICATIONS

Not applicable

FEDERALLY SPONSORED RESEARCH

Not applicable

SEQUENCE LISTING OR PROGRAM

Not applicable

BACKGROUND OF THE INVENTION

1. Field of the Invention

This invention generally relates to sanders, specifically to powered drywall sanders.

2. Prior Art

Power sanders have been used to sand drywall, but due to shortcomings in previous designs, have had only limited success. All known previously designed sanders required the tubular wand to be held essentially parallel to the surface being sanded. A need exists to provide a way to adjust the basic head angle so that the tubular wand may be held in that manner (more or less parallel to the surface being sanded as in sidewall work), or may be adjusted so that for ceiling sanding the wand may be held much lower and in close to the operator's body. Previous designs forced the user to hold the wand with outstretched arms up overhead in order to keep it parallel to the ceiling. Actually performing the sanding operation on ceilings holding the sander in this manner is awkward, unwieldy and very tiring. Previous rotating disk sanders for drywall failed to provide a means to change the basic angle of the sanding head assembly and lock it into place while allowing the disk to freely pivot in any direction and not encounter any interference from the drive cable. These shortcomings made ceiling sanding extremely difficult.

Another problem that had not been solved is interference from the dust collection ring as the sanding disk is being engaged to the work surface. This interference is caused by previous designs requiring too great a pressure to move the ring back as the disk is being engaged. This causes loss of disk control and difficulty in using the machine. The problem was so severe that most users discard the ring altogether, however the resulting dust storm made ceiling sanding nearly impossible and wall sanding very dusty and dangerous to the operator's eyes.

Still another missing feature on previous designs is an integral on board vacuum dust bagging system. Lack of this feature made it necessary to attach the sander to a separate hard to maneuver vacuum machine and cumbersome hose dramatically slowing production. The presence of this hose interfered so greatly with the maneuverability and mobility of the sander, making it slow and cumbersome, that the dust collecting feature was almost never used.

OBJECTS AND ADVANTAGES

Accordingly, several objects and advantages of my invention are:

(a) to provide for a means to adjust the angle of the sanding head assembly.

(b) to provide angle locking mechanism for the sanding head assembly.

(c) to provide for the ability of the sanding head assembly to pivot in any direction within the parameters of the chosen locked angle position.

(d) to provide means to adjust the amount of tension the drive cable housing exerts on the backer plate. (A feature absolutely necessary to maintain good control of the sanding disk.)

(e) to provide means to hold sander lower and closer to operator's body to minimize strain while sanding overhead on ceilings.

(f) to provide an independently mounted full floating dust ring that requires very little pressure to move back and does not interfere with engagement of sanding disk.

(g) to provide integral completely self contained dust bagging system.

(h) to eliminate any hose connecting sander to separate vacuum machine.

(I) to design a sander that does not throw dust into operator's eyes.

(j) to make a power drywall sander that collects and bags it's own dust, thereby remaining safe, highly maneuverable, mobile and fast.

Further objects and advantages will become apparent from the consideration of the ensuing description and drawings.

SUMMARY

This invention relates to a power sander for drywall with a self-contained on board vacuum dust bagging system. One embodiment comprises a body tube with a vacuum assembly mounted on one end, and a sanding head assembly mounted on the other. The sanding head assembly is adjustable to any angle and the disk can be pivoted in any direction. A dust collection ring of the non-interfering full floating type is provided. These features and advantages will be more apparent upon reading the description and viewing the drawings.

DETAILED DESCRIPTION

Figure 1:
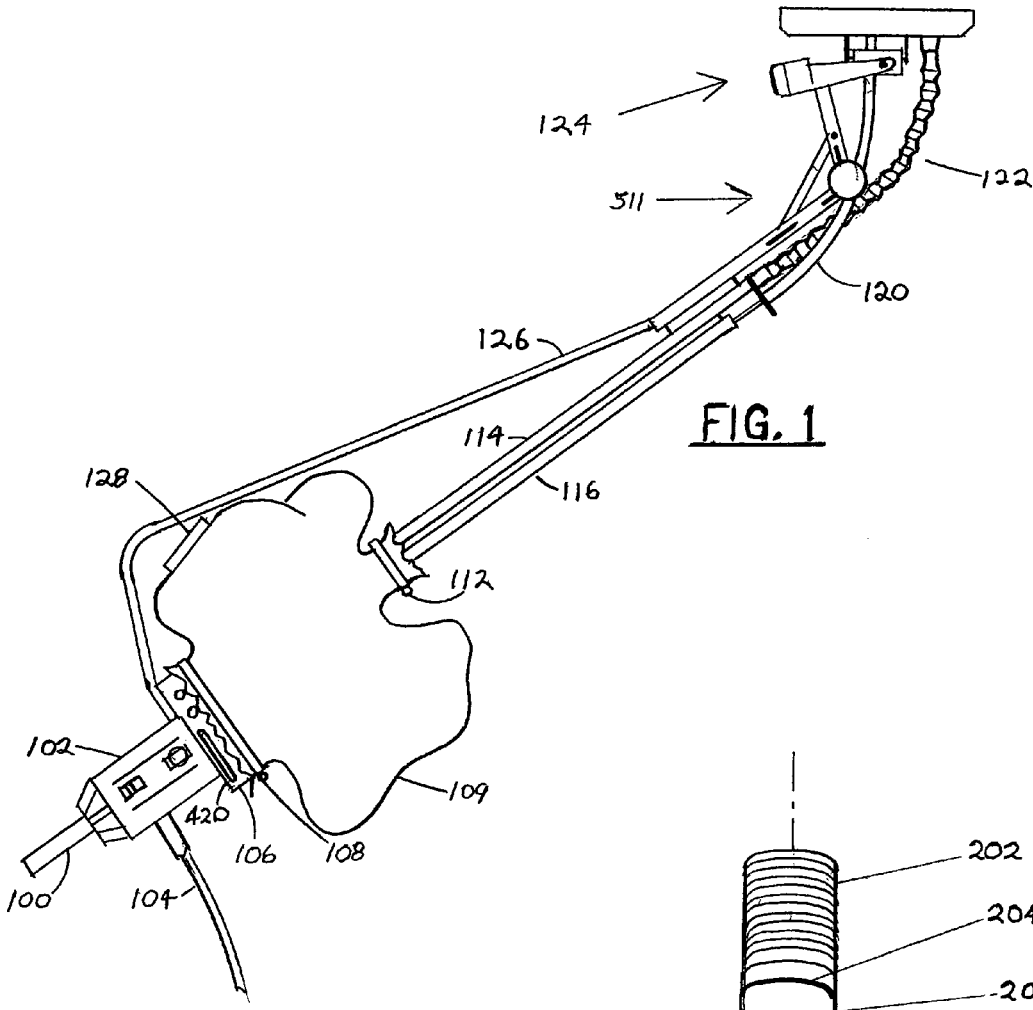
FIG. 1 is an isometric view of a motorized vacuum sander.

This discussion will show the construction and operation of a power drywall sander with a self contained on board vacuum dust bagging system. Those skilled in the art will appreciate the precise disk control and ease of handling it provides whether sanding ceilings or sidewalls. This precision is produced by providing a means to set the sanding head assembly 124 to any angle while also providing a means to keep drive cable housing 120 urging on backer plate 538 light. An adjustment mechanism 511 is provided for this purpose. This mechanism comprises bracket 501, bracket extension 508, brace 504, slots 502A, 502B, and 502C, locking knob 505 and locking wing nut 503. When the desired angle and cable length have been selected, the knob 505 and wing nut 503 may be tightened to secure the mechanism 511.

Another very important performance feature is the sliding action of the dust ring 534. It can move up and down freely on slide pins with springs 536 with only very light pressure applied. This "floating" action prevents it from interfering with the operator's "feel" of engaging the sanding disk 516 to the work surface.

Another indispensable feature is the sander's ability to collect and bag it's own dust. No auxiliary vacuum source is required. This eliminates being tethered by a cumbersome hose to a separate vacuum source. This makes the sander quick to move and easy to handle.

FIG. 1 shows the sander in isometric view which includes a rear handle 100 attached to drive motor 102. A power supply cord 104 is provided. The motor 102 is attached to the vacuum assembly rear end plate 420. A vacuum assembly housing 106 and dust bag 109 are attached to a proximal end of body tube 114. A sanding head assembly 124 is fastened to a distal end of tube 114. Flexible drive cable housing 120 and flexible dust tube 122 are shown. Top handle 126 is provided to give operator more leverage on overhead ceiling work. Cap 128 is provided for quick dust removal from dust bag 109.

Figure 2:
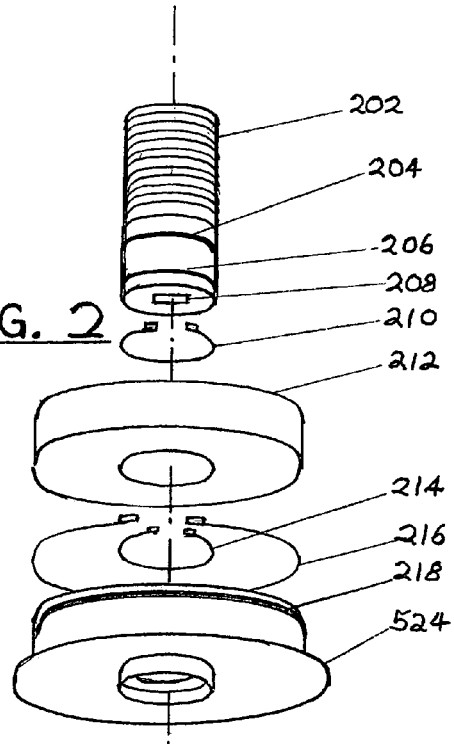
FIG. 2 is an exploded view of the drive disk threaded arbor, its bearing, mounting flange, and retaining rings.

FIG. 2 shows and exploded view of a threaded arbor 202, a bearing 212, and a flange 524, along with retaining rings 210, 214, and 216.

Figure 3:
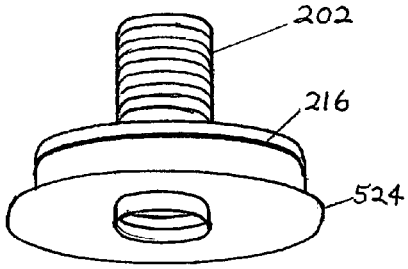
FIG. 3 is a fully assembled view of the parts shown in FIG. 2.

FIG. 3 is a fully assembled view of the parts in FIG. 2.

Figure 4:
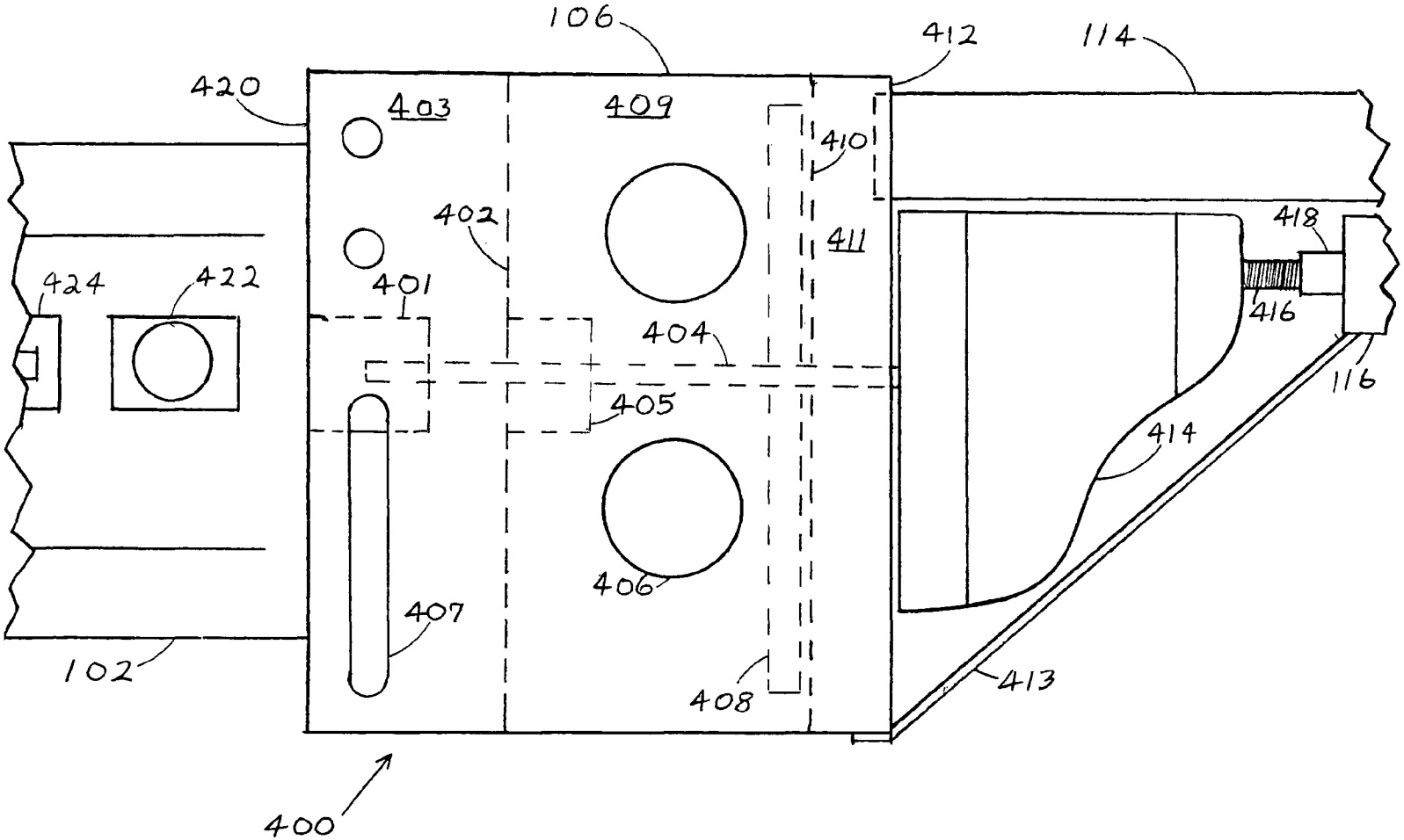
FIG. 4 is an isometric view of the vacuum assembly including internal parts.

FIG. 4 is an isometric view of a vacuum assembly 400. A motor 102 is coupled to a shaft 404 using a collet 401. Shaft 404 extends through dust chamber rear plate 402, dust seal 405, fan 408, dust chamber front plate 410, vacuum chamber 411, vacuum assembly front end plate 412, and into gearbox 414. Rotating shaft 404 turns fan 408 creating a vacuum. This vacuum pulls dust from assembly 124, through tube 114 and into vacuum chamber 411. Dust is then pulled from chamber 411 into the fan 408 and propelled through dust exhaust ports 406. Dust bag 109 surrounds vacuum assembly housing 106 and catches all blown dust. Rotating shaft 404 also turns gearbox 414. Gearbox 414 is connected to flexible drive cable 416 which passes through flexible drive cable sheath 418, and flexible drive cable housing 120. Flexible cable's 416 distal end slips into threaded arbor socket 208 and rotates drive disk 514. A structural brace 413 is provided to stabilize the vacuum assembly 400 and body tube 114 connection.

Figure 5:
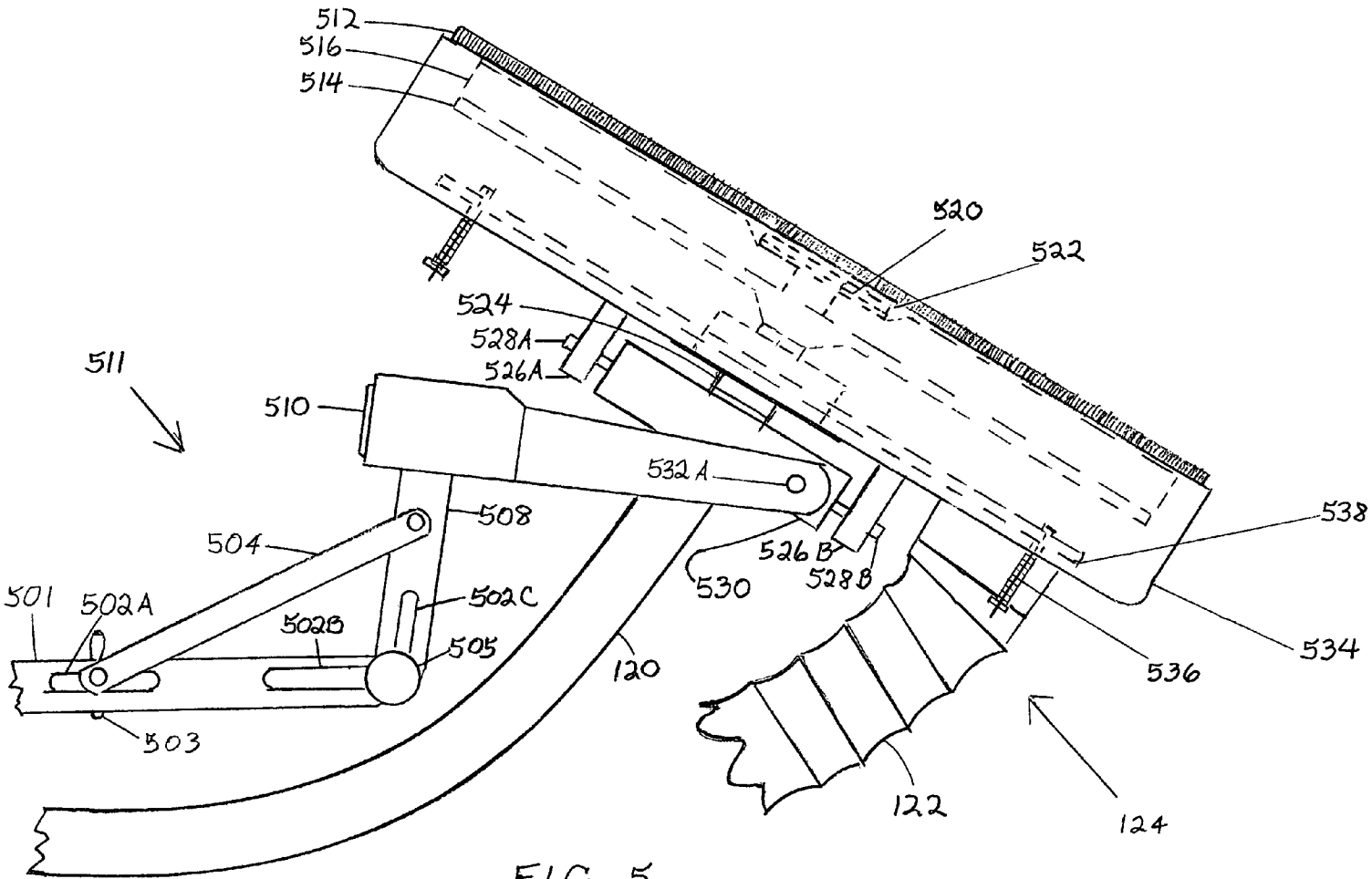
FIG. 5 is a detailed view of the sanding head assembly and the angle adjustment mechanism on which it is mounted.

FIG. 5 shows the sanding head assembly 124 and adjustment mechanism 511. Assembly 124 parts are: bearing flange 524, bearing and retaining rings, (not shown) threaded arbor 202, drive disk 514, sanding disk 516, washer 520 and nut 522. Other parts include a plurality of slide pins with springs 536, flexible dust tube 122, flexible drive cable housing 120, and brush contact ring 512. Adjustment mechanism assembly 511 comprises bracket 501, bracket extension 508, brace 504, locking knob 505, and locking wing nut 503. The bracket extension 508 is rigidly fastened to fork 510 which is connected to sanding head assembly 124 at pivot block 530. Block 530 provides duel axis pivoting action. The first block 530 axis is in line with pivot pins 532 A and 532 B (not shown). The second block 530 axis is in line with pivot pins 528 A and 528 B. These two axis allow the sanding head assembly 124 to be pivoted in any direction.

Figure 6:
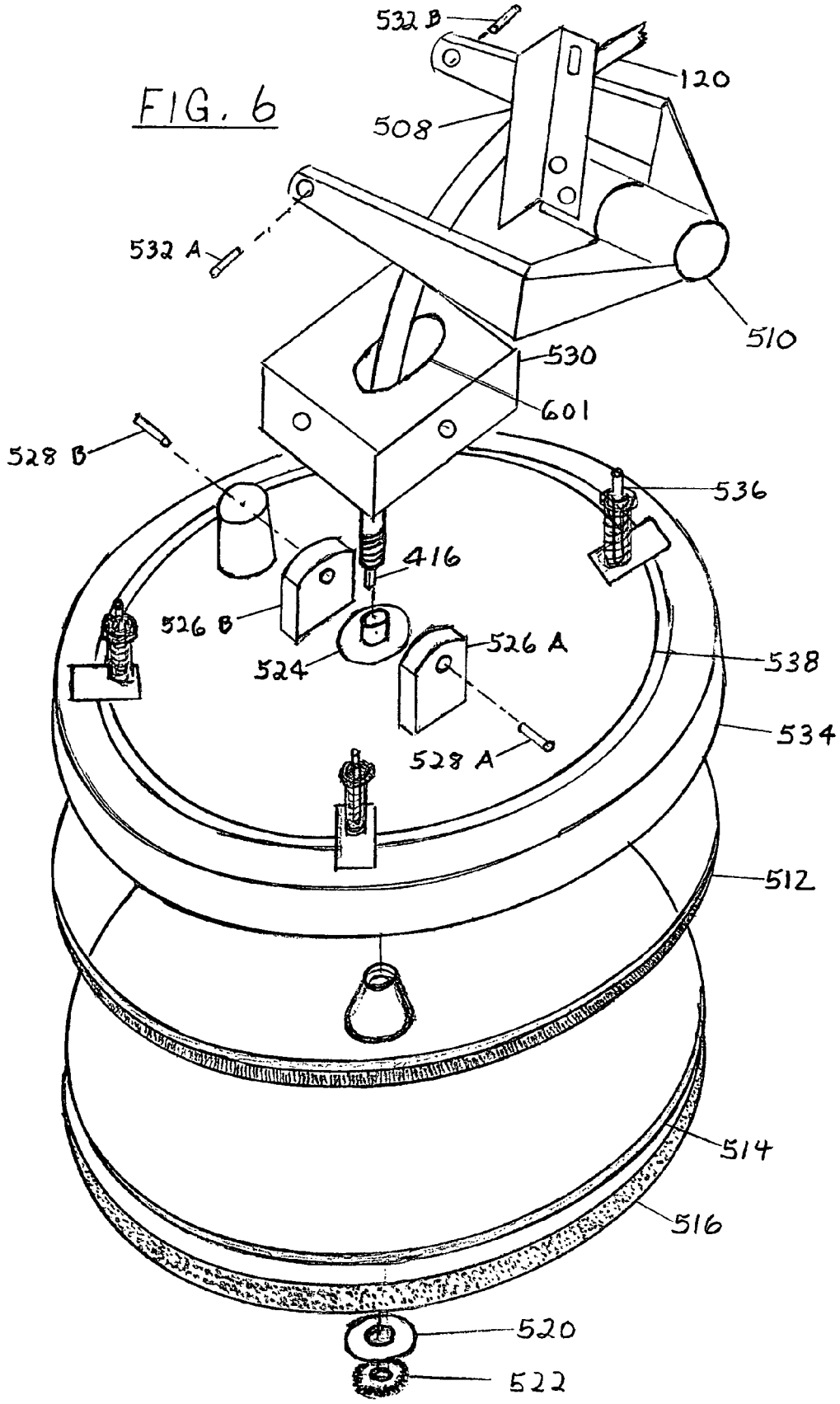
FIG. 6 is an exploded perspective view of the sanding head assembly with its pivoting mechanism.

FIG. 6 is an exploded perspective view of sanding head assembly 124. Beginning with fork 510 which is operatively coupled to pivot block 530 using pins 532 A and 532 B. Block 530 is operatively coupled to backer plate 538 lugs 526 A and 526 B using pins 528 A and 528 B. Flexible drive cable 416 and housing 120 inserts through oval access hole 601 in block 530. Housing 120 screws into bearing flange 524 and drive cable 416 slips into threaded arbor socket 208. The slide mounted dust ring 534 is mounted on a plurality of slide pins with springs allowing it to move up and down freely with only very light pressure applied. A brush dust ring 512 for surface contact inserts up into a groove provided in the slide mounted dust ring 534. Drive disk 514 screws onto threaded arbor 202. A sanding disk 516 installs onto drive disk 514 with washer 520 and nut 522.

OPERATION_PREFERRED EMBODIMENT

This powerful vacuum sander may be used in the following manner. First, the angle of sanding head assembly 124 must be set for the work at hand. The angle adjustment mechanism 511 is used to do this. The angle formed by bracket 501 and extension 508 is adjustable. For lower sidewalls and higher overhead sidewalls, the angle should be set at about 100 degrees. This allows for body tube 114 to be held in closer to the work surface. For ceilings the setting should be somewhat higher, about 125 to 135 degrees. This allows for body tube 114 to be held much lower and closer to the operator's body, affording better control and less fatigue. This higher setting may also be used on sidewalls where you're forced to stand back away from the wall some due to space limitation such as inside a small closet.

While setting the angle of the sanding head assembly 124, your attention should also be directed to the mount of tension that the drive cable housing 120 is exerting on the backer plate 538. Some tension is required for good disk control, however, too much tension will not allow the assembly 124 to freely pivot as it must. Perfect drive cable housing 120 tension adjustment is possible using the slots 502 A, B, and C to position the bracket extension 508 in just the right place to match the length requirements of the drive cable housing 120 for the chosen angle position.

The next step is to install a sanding disk 516 on the drive disk 514. The particular grit chosen must match the hardness of the mud being sanded. Too coarse of a grit will cause scratching if used on some of the softer muds. The washer 520 and nut 522 are used to fasten the sanding disk 516 to the drive disk 514.

Plug the cord 104 into a proper power source and turn on switch 424. Set motor 102 speed at the desired level using control knob 422. Engage sanding head assembly 124 gently onto sheetrock, and then move onto mud joint area for smoothest results.

The sanding dust created will be sucked up by the powerful vacuum assembly 400 and blown into the dust bag 109. The dust may be dumped as often as desired using the dust bag cap 128. This sander, whether sanding sidewalls or ceilings, throws no dust on the operator. Since it is not tethered to a separate vacuum machine, it is easy to handle, mobile and fast.

CONCLUSION, RAMIFICATIONS AND SCOPE

The present invention, being a motorized self-contained vacuum sander with head angle adjustment mechanism has features that will satisfy a long standing and deeply felt need in the drywall industry, and has tremendous advantages over all previous designs. These features include:

1. A head angle adjustment mechanism that makes ceiling sanding just as easy as sidewalls. For ceilings the angle may be set higher allowing the sander to be held down lower and closer to the operator's body for better control and less strain. To make sidewall sanding easier, the head angle may be set lower allowing the sander to be held more nearly parallel to the wall.

2. A cable tension adjustment mechanism which gives the operator precise disk control for perfect sanding results regardless of the head angle chosen for either ceilings or sidewalls.
3. A self contained on board vacuum dust bagging system with no external hose connecting the sander to a separate machine. The ramifications of this feature are serious: no more dust in the operator's eyes! No more using the sander without a dust removal system because of the awkwardness of an external hose. The absence of a hose tethering the sander to a heavy auxiliary vacuum machine is a feature of monumental proportions, making the sander user friendly beyond all expectations. These combined features make the sander safe, highly mobile, easy to handle, and FAST!

Of course, it will be understood that even though numerous characteristics and advantages of the present invention have been shown in the detailed description, this disclosure is for illustration only, and changes may be made in detail, shape, size and arrangement of components within the principals of the present invention which are broadly expressed in the appended claims.

LIST OF REFERENCE NUMERALS

100_rear handle
102_motor
104_power cord
106_vacuum assembly housing
108_rear bag clamp
109_dust bag
112_front bag clamp
114_upper body tube
116_lower body tube
120_drive cable housing
122_flexible dust tube
124_sanding head assembly
126_main handle
128_dust bag cap
202_threaded arbor
204_groove for retaining ring "A"
206_groove for retaining ring "B"
208_square socket to receive flexible drive cable
210_bearing retaining ring "A"
212_bearing
214_bearing retaining ring "B"
216_bearing flange retaining ring
218_groove for bearing flange retaining ring
400_vacuum assembly
401_collet
402_dust chamber rear plate
403_motor ventilation chamber
404_main drive shaft
405_dust seal
406_dust exhaust ports
407_exhaust ports for motor cooling air
408_centrifugal fan
409_dust chamber
410_dust chamber front plate
411_vacuum chamber
412_vacuum assembly front end plate
413_structural brace
414_gearbox
416_flexible drive cable
418_flexible drive cable sheath
420_vacuum assembly rear end plate
422_motor speed control knob
424_motor on/off switch
501_bracket
502A, B and C cable tension adjusting slots
503_wing nut
504_angle brace
505_angle adjusting/locking knob
508_bracket extension
510_fork
511_sanding head angle adjustment mechanism
512_brush contact dust ring
514_drive disk
516_sanding disk
520_washer
522_nut
524_bearing flange
526A and B_backer plate lugs
528A and B_lateral pivot pins
530_pivot block
532A and B_longitudinal pivot pins
534_slide mounted dust ring
536_slide pins with springs
538_backer plate
601_oval access hole for drive cable housing

I claim:

1. A drywall sander comprising:

(a) a motor driven self-contained vacuuming dust storage assembly including a dust bag and housing surrounding a centrifugal fan, a sealed dust chamber and a vacuum chamber; said assembly operationally coupled to a body tube's first end, and operationally coupled to a second end of the body tube end is:

(b) a sanding assembly surrounded by a floating action brush contact ring, said ring slidably mounted on a plurality of slide pins fastened perpendicularly at predetermined locations around a perimeter of a backer plate.

2. The sander of claim 1 wherein said floating action brush contact ring is capable of sliding up a length of said pins to an up position, and sliding down said length of said pins to a down position, said ring capable of being urged into said down position by a plurality of springs.

3. The sander of claim 2 whereby said being urged by said springs is a substantially small predetermined amount of urging, thereby allowing said floating action brush contact ring to brush over a work surface with a floating action contact.

* * * * *